United States Patent [19]

Pierart

[11] 4,398,484

[45] Aug. 16, 1983

[54] ARRANGEMENT FOR INSTALLING A NUCLEAR REACTOR BLOCK IN A VESSEL

[75] Inventor: Robert Pierart, Nantes, France

[73] Assignee: Ateliers et Chantiers de Bretagne-ACB, Nantes, France

[21] Appl. No.: 212,055

[22] PCT Filed: Feb. 6, 1980

[86] PCT No.: PCT/FR80/00020

§ 371 Date: Oct. 7, 1980

§ 102(e) Date: Sep. 22, 1980

[87] PCT Pub. No.: WO80/01662

PCT Pub. Date: Aug. 21, 1980

[30] Foreign Application Priority Data

Feb. 7, 1979 [FR] France ..... 79 03088

[51] Int. Cl.[3] ..... B63B 3/00; B63B 5/00; B63B 9/06

[52] U.S. Cl. ..... 114/65 R; 114/77 R; 114/352; 114/269; 414/391; 254/30

[58] Field of Search ..... 114/65 R, 65 A, 77 R, 114/78, 221 R, 269, 352; 9/25; 414/416, 417, 391, 608; 254/29, 30

[56] References Cited

U.S. PATENT DOCUMENTS

| | | | |
|---|---|---|---|
| 328,828 | 10/1885 | Way | 414/391 |
| 1,509,400 | 9/1924 | Fitch | 414/391 |
| 2,911,190 | 11/1959 | Crbason | 254/29 R |
| 3,370,563 | 2/1968 | Muto | 114/65 R |
| 3,765,359 | 10/1973 | Takezawa | 114/65 R |
| 3,951,088 | 4/1976 | Hikai | 114/65 R |
| 4,018,180 | 4/1977 | Yoshida | 114/65 R |
| 4,276,847 | 7/1981 | Ivanov | 114/65 R |

FOREIGN PATENT DOCUMENTS

| | | | |
|---|---|---|---|
| 2625632 | 12/1976 | Fed. Rep. of Germany | 114/65 R |
| 2276985 | 1/1976 | France | 114/65 R |
| 2354237 | 6/1978 | France | 114/65 R |
| 957236 | 3/1962 | United Kingdom | 414/417 |
| 2001013 | 1/1979 | United Kingdom | 114/65 R |

OTHER PUBLICATIONS

Hydraulics for Heavy Transport Ship—Fluid Power Intl., 7/1965.

*Primary Examiner*—Trygve M. Blix
*Assistant Examiner*—D. W. Keen
*Attorney, Agent, or Firm*—Sughrue, Mion, Zinn, Macpeak & Seas

[57] ABSTRACT

The invention relates to a method and an assembly for a equipping vessel propelled by nuclear power. In accordance with the invention, a vessel is made in two prefabricated parts (2,3) and a chamber (5) is provided in the part (2). A nuclear reactor block (6) is placed in said chamber before assembling the two parts. The invention applies to building diverse nuclear powered vessels such as ice-breakers for example.

3 Claims, 12 Drawing Figures

ARRANGEMENT FOR INSTALLING A NUCLEAR REACTOR BLOCK IN A VESSEL

FIELD OF THE INVENTION

The present invention essentially relates to an assembly for installing a nuclear reactor block in a vessel.

BACKGROUND OF THE INVENTION

Up till recently, nuclear reactors have been built directly inside vessels, the reactors being assembled part by part using the hoisting machines usually emloyed in shipyards.

Some of the parts constituted undividable masses weighing several hundreds of metric tons. The result is that it has been practically impossible to envisage building a vessel propelled by nuclear power except in those few shipyards which have exeptionally powerful hoisting means available.

Further, such building of a nuclear reactor on board a vessel has required a very long time performance and has occupied the ship-building dock for an excessively long period. This has disorganized the construction program and incurred prohibitive costs.

Lastly, the working conditions when assembling reactors on board vessels have been unsatisfactory, in particular in so far as work could not be performed in conditions of real nuclear cleanliness.

That is why, in accordance with a known method, it has been proposed to form vessels in two prefabricated floating parts which are subsequently assembled together, one of the parts including a chamber in which a nuclear reactor block is inserted by a horizontal translation movement before the two parts are assembled together. A complex operation is required to install the nuclear reactor because of its bulk and its weight (several thousands of metric tons).

SUMMARY OF THE INVENTION

The invention aims to facilitate said positioning. It provides an assembly for installing a nuclear reactor block in a vessel. The vessel is built in at least two prefabricated parts which are then assembled end to end, one of the parts including a chamber in which said block may be inserted before said parts are assembled by a substantially horizontal translation movement of said block from a barge by rolling or sliding onto a temporary support situated in said chamber. The invention is characterized in that said arrangement assembly includes hoisting means composed of a plurality of guide columns for guiding the block in a vertical translation movement, the tops of said columns being provided with jacks from which said block is suspended by cables or the like and which allow it to be raised momentarily to remove the temporary support and to be lowered to make it rest in its final position in the aforementioned chamber.

Other characteristics and advantages of the invention become more clearly apparent from the following detailed description which refers to the accompanying drawings given only by way of example.

DESCRIPTION OF THE PREFERRED EMBODIMENT

Figures 1, 2, 3, 4, 5, 6, 7:
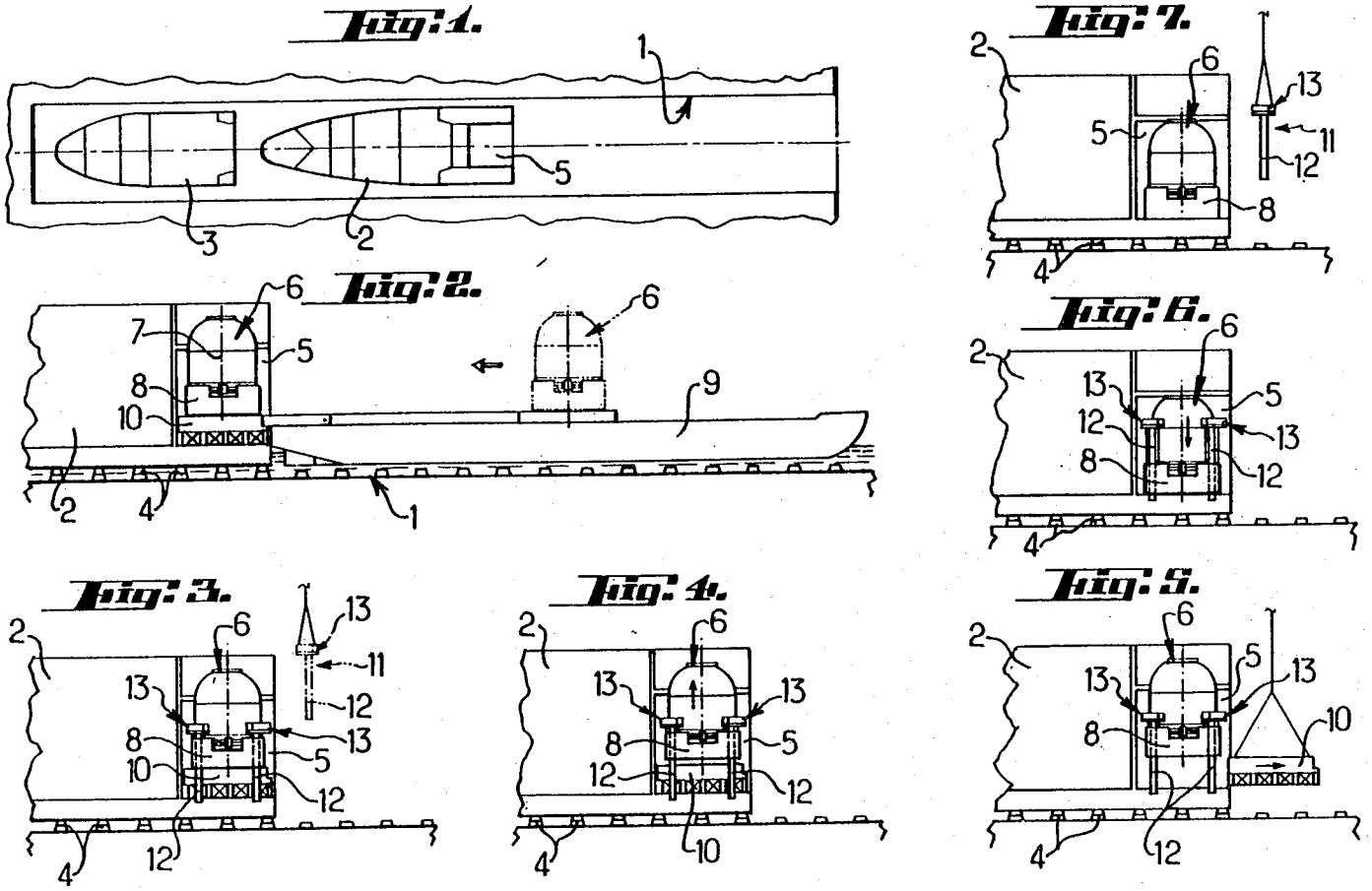
FIGS. 1 to 9 are schematic and in order plan views (FIGS. 1, 8 and 9) and elevation views (FIGS. 2 to 7) of a vessel during the various stages of the building and equipping method in accordance with the invention.
Figure 8:
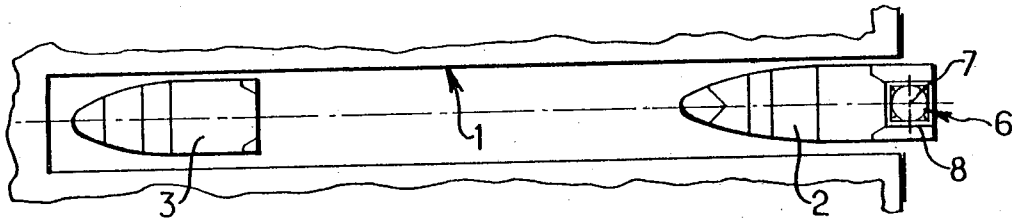

In accordance with one embodiment of the invention and referring in particular to FIGS. 1 to 10, a method of manufacturing and equipping a vessel propelled by nuclear power in accordance with the invention includes the following steps:

As seen clearly in FIG. 1, firstly, in a ship-building dock 1, a hull is built in two parts, namely, a fore part 2 and an aft part 3. The fore part 2 which rests in the dock 1 on chocks 4 has a chamber 5 designed to house a nuclear reactor or boiler block 6. In short, said block 6 is constituted by a casing 7 which contains in particular a tank and steam generators, not shown, said casing 7 and its contents being supported by a stand 8 with which moving means, not shown, are associated.

As shown clearly in FIG. 2, the reactor block 6 is transported to the neighbourhood of the chamber 5 by means of a barge 9 brought into the dock 1 after the dock has been flooded. Here, it must be observed that a temporary support 10 of the reactor block 6 is disposed in the chamber 5 and that said support may be constituted, for example, by longitudinal members, props or the like. Said support 10 is essential because it compensates for the difference in level between the deck of the barge 9 and the chamber 5.

Therefore, the reactor block 6 is brought into the chamber 5 in a translation movement by sliding or rolling it on the barge until it reaches the support 10 provided in the chamber 5, as claerly shown in FIG. 2.

When the reactor block has been placed inside the chamber, the barge 9 is removed and as shown in FIG. 3 hoisting means 11 for raising the block 6 are brought by cranes or the like into the intermediate neighbourhood thereof and the block is connected to said hoisting means. More precisely, the hoisting means 11 (which are described in detail later with reference to FIGS. 11 and 12) essentially include guide columns 12 for guiding the block 6 in a vertical translation movement, the tops of said columns being provided with jacks 13 from which the block 6 can be suspended.

As illustrated in FIG. 3, the guide columns 12 are fitted into the stand 8 of the reactor block 6 and rest on the deck of the chamber 5.

Thus, by controlling the jacks 13, the unit 6 can momentarily be raised up the columns 12 as shown in FIG. 4. This allows the temporary support 10 to be removed as shown in FIG. 5.

As shown in FIG. 6, the reactor block is then lowered down the guide columns 12 so that it rests in its final position in the chamber 5, and, as shown in FIG. 7, the hoisting means temporarily installed, as described hereinbefore, are removed.

Figure 9:
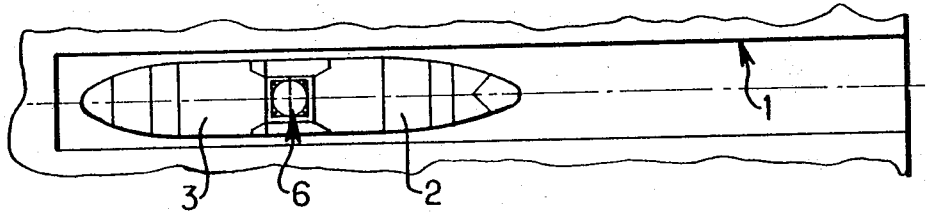
Figure 10:
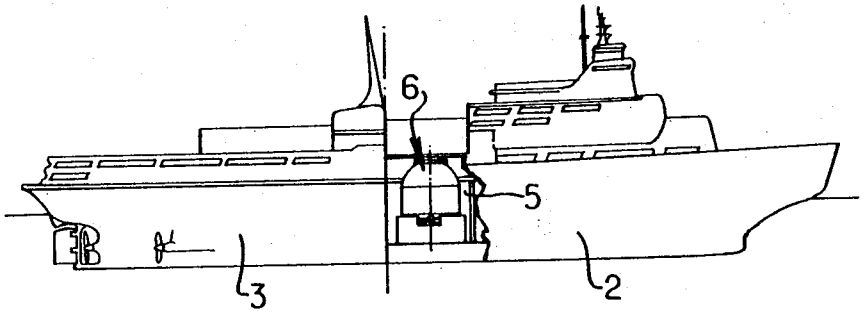
FIG. 10 is a partially cut away schematic elevation of the vessel when building is completed.

Since the reactor block 6 is thus finally in position in the fore part of the vessel, the fore part of the vessel leaves the dock 1 (FIG. 8), is turned about and enters the dock again so as to assemble the fore part 2 end to end with the part 3 as shown in FIG. 9. Finally, a vessel such as illustrated in FIG. 10 is obtained.

Neither the various building and end-to-end connection operations relating to the two parts of the vessel, nor the work connected therewith and required by the presence of the reactor unit will be described here in detail, which work can be accomplished in parallel with the actual construction operations, since, as must be stated again, the present invention aims essentially to insert the block in a chamber in one part of the vessel by a horizontal translation movement and to install said part in said chamber.

Figure 11:
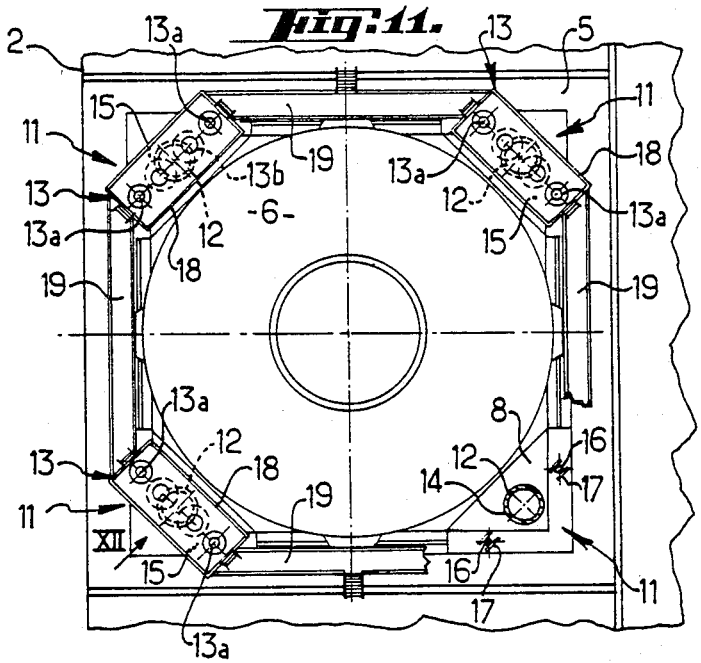
FIG. 11 is a top view of the reactor block provided with hoisting means therefor.
Figure 12:
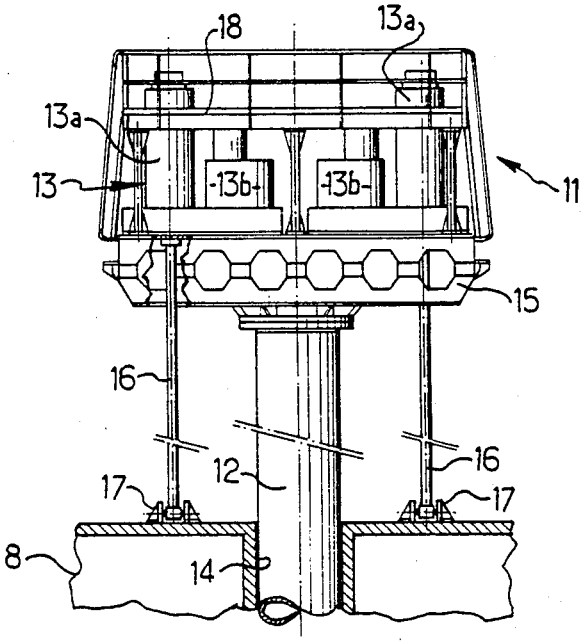
FIG. 12 is an elevation in the direction shown by arrow XII in FIG. 11, of part of a column whose top is equipped with jacks.

In this connection, detachable hoisting means 11 are shown on a larger scale in FIGS. 11 and 12, said means allowing vertical translation movement of the reactor block 6 in its chamber for final installation of said block.

In accordance with the embodiment illustrated in these figures, there are four of these hoisting means and they consequently include four guide columns 12 which are inserted through orifices 14 provided at the four corners of the stand 8 of the reactor block 6. As shown clearly in FIGS. 11 and 12, the tops of the columns 12 are integral with a platform 15 which carries jacks 13 whose bodies are shown at 13*a* and whose hydraulic units are shown at 13*b*.

Said jacks 13 are connected to the reactor block 6 and more precisely to the stand 8 by cables 16 or the like fixed at 17 to the stand as illustrated in FIG. 12.

The cables can be constituted by a plurality of screwed segments which include heads at one end and which pass through the bodies of the jacks 13*a* in a manner known per se. Thus, advantageously, such cables allow the reactor block 6 to be raised or lowered in successive stages or step by step.

In FIG. 12, a catwalk 18 allows the operator to work in full safety conditions in the neighbourhood of the jacks 13. Lastly, interconnection catwalks 19 are provided in accordance with the invention between the four hoisting means 11.

Of course, the invention is in no way limited to the embodiment described and illustrated, which is given only by way of an example.

Thus, it is indeed possible to apply the principles of the invention without going beyond the scope thereof by adopting a building sequence for the vessel which is a different sequence from that described hereinbefore. It is also possible to apply the invention to constructing a nuclear power block on a barge.

Further, without going beyond the scope of the invention, the reactor block can be inserted laterally in a vessel which is being built in a building dock or in a dry dock of a shipyard.

The invention therefore includes all technical equivalents of the means described as well as combinations thereof which do not depart from the spirit of the invention and are brought into effect within the scope of the following claims.

I claim:

1. An assembly for installing a nuclear reactor block in a vessel, said vessel being built in at least two prefabricated parts which are then assembled end to end, one of the parts including a chamber in which said block may be inserted before said parts are assembled by a substantially horizontal translation movement of said block from a barge by rolling or sliding onto a temporary support situated in said chamber, the improvement wherein said assembly includes hoisting means composed of a plurality of guide columns borne by said one part for guiding the block in a vertical translation movement, jacks provided to the tops of said columns, cables for suspending said block, said cables allowing said block to be raised momentarily to remove the temporary support and to be lowered to make it rest in its final position in said chamber.

2. An assembly according to claim 1, wherein the tops of said columns are integral with a platform which supports the said jacks.

3. An assembly according to claim 1 or claim 2, wherein said block includes a stand provided with through orifices within which the said columns are inserted.

* * * * *